US011435152B2

(12) United States Patent
Roth

(10) Patent No.: US 11,435,152 B2
(45) Date of Patent: Sep. 6, 2022

(54) FIREARM LOADING SYSTEMS AND FIREARMS INCLUDING LOADING SYSTEMS

(71) Applicant: HECKLER & KOCH GmbH, Oberndorf (DE)

(72) Inventor: Marc Roth, Oberndorf (DE)

(73) Assignee: HECKLER & KOCH GmbH, Oberndorf (DE)

( * ) Notice: Subject to any disclaimer, the term of this patent is extended or adjusted under 35 U.S.C. 154(b) by 0 days.

(21) Appl. No.: 17/203,264

(22) Filed: Mar. 16, 2021

(65) Prior Publication Data

US 2021/0348864 A1 Nov. 11, 2021

(30) Foreign Application Priority Data

Mar. 17, 2020 (DE) ..... 10 2020 107 320.8

(51) Int. Cl.
*F41A 9/53* (2006.01)

(52) U.S. Cl.
CPC ..... *F41A 9/53* (2013.01)

(58) Field of Classification Search
CPC ..... F41A 9/53
USPC ..... 42/1.04, 1.05
See application file for complete search history.

(56) References Cited

U.S. PATENT DOCUMENTS 5,311,691 A * 5/1994 Cacek ..... F41A 17/42 42/70.01
6,976,416 B2 * 12/2005 Ealovega ..... F41A 19/67 89/129.01
8,464,451 B2 * 6/2013 McRae ..... F41A 9/53 42/122
9,441,904 B2 * 9/2016 Seymore ..... F41A 3/12
2005/0235546 A1 10/2005 Wonisch et al.
(Continued)

FOREIGN PATENT DOCUMENTS

DE 10 2004 006 364 8/2005

OTHER PUBLICATIONS

German Patent Office, "Office Action", issued in connection with German Patent Application No. 10 2020 107 320.8, dated Dec. 8, 2020, with English Translation, 10 pages.
(Continued)

*Primary Examiner* — John Cooper
(74) *Attorney, Agent, or Firm* — Hanley, Flight & Zimmerman, LLC

(57) ABSTRACT

The invention relates to a firearm comprising one or more retractable loading system elements, specifically at least one from a loading device, breechblock carrier, or slide. These each follow a trajectory when retracted. The firearm also comprises one or more reference elements, which indicate such a predetermined position of the loading system elements along their respective trajectories, at which the chamber is opened, such that a cartridge potentially located in the chamber can be seen and/or felt, but is not ejected. The predetermined position of the loading system element is distanced to possible positions for disassembling the firearm, and the one or more reference elements are formed such that they ensure that the loading system elements can travel freely along their respective trajectories when the safety for the firearm is either on or off.

15 Claims, 13 Drawing Sheets

(56) References Cited

U.S. PATENT DOCUMENTS

2010/0031552 A1* 2/2010 Houde-Walter ..... F41C 23/16
42/72

OTHER PUBLICATIONS

European Patent Office, "Extended European Search Report," issued in connection with European Patent Application No. 21159162.3, dated Aug. 6, 2021, with English machine translation, 21 pages.
Training with AJ: "How to Do a Press Check on Semi-Auto Pistol," Youtube, Nov. 23, 2014, URL:https://www.youtube.com/watch?v=X9QSsi5qybl, 4 pages.

* cited by examiner

FIREARM LOADING SYSTEMS AND FIREARMS INCLUDING LOADING SYSTEMS

RELATED APPLICATION

This patent claims priority to German Patent Application No. 10 2020 107 320.8, which was filed on Mar. 17, 2020. German Patent Application No. 10 2020 107 320.8 is hereby incorporated herein by reference in its entirety.

FIELD OF THE DISCLOSURE

This disclosure relates generally to firearms and, more particularly, to firearm loading systems.

BACKGROUND

When handling firearms, safety plays an important role. This prevents unintentional firing. In addition to the weapon's safety, knowledge of the loading state of a firearm is an important aspect. A shooter must be able to determine whether there is a cartridge in the chamber, or if the weapon is already loaded and is therefore ready to be fired. The Government Accountability Office in the USA assumes that by using a loading state indicators, approx. 20% of the deaths caused by unintentional firing could be prevented. Furthermore, a loading state indicator also indicates when the weapon is ready to fire, or be put to use, such that a firearm is immediately ready to fire, without having to be loaded, which may take up valuable time.

BRIEF DESCRIPTION OF THE DRAWINGS

All of the drawings use the same reference symbols for the same elements. Explanations for one figure relate analogously to the other figures.

DETAILED DESCRIPTION

Figure 1:
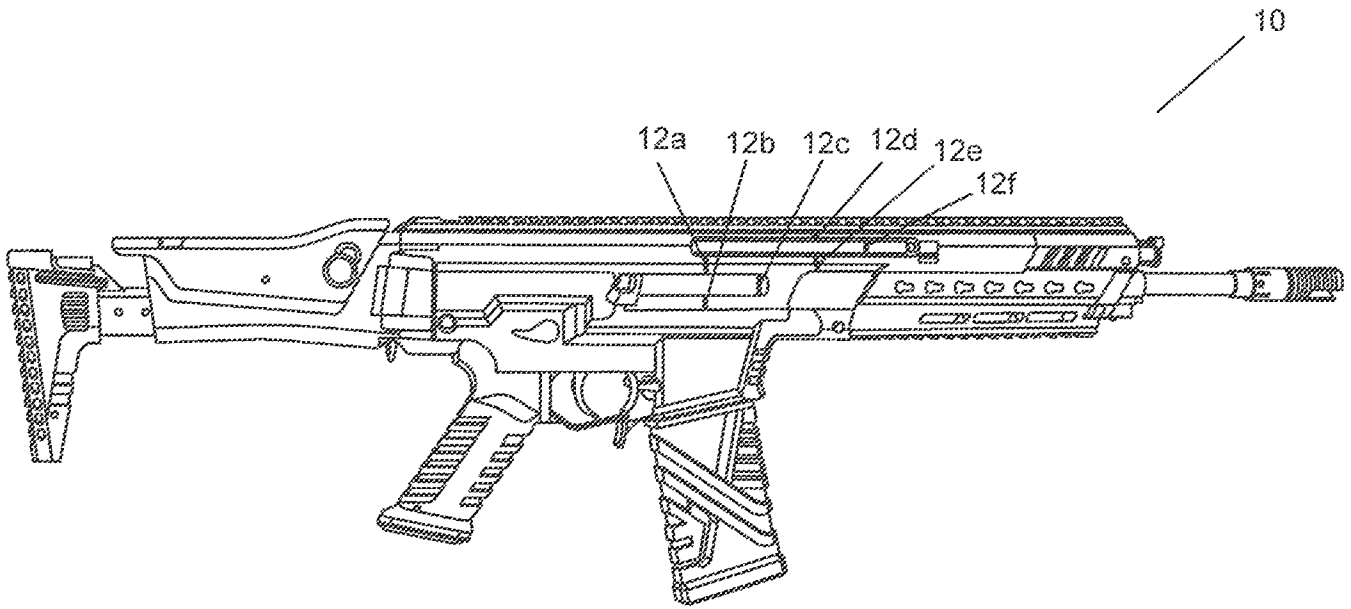
FIG. 1 shows the right-hand side of an assault rifle with vertical reference elements.

There are known mechanical devices that indicate the loading state of rifles and handguns. A shooter can use loading state indicators, for example, for determining the loading state of the firearm.

The German Armed Forces pistol Walther P1 has a pin, which passes through a rear part of a slide, that indicates whether there is a cartridge in the chamber when the breech is closed. When the breech is closed, a cartridge in the chamber pushes an indicator pin, which is slightly spring-loaded in a firing direction and which protrudes from the impact base, toward the rear. As a result, a rear end of the indicator pin protrudes above the hammer from the rear end of the slide such that the pin can be seen and felt, thus indicating the presence of a cartridge in the chamber. If no cartridge is in the chamber, the spring pushes the front end of the indicator pin into the empty chamber. As such, the rear end of the pin disappears into the slide and can no longer be seen or felt.

Other pistols on the market make use of an extractor that protrudes when a cartridge is in the chamber.

One known example of this is the P08 pistol, on which the word "Geladen" ["loaded"] can be read on an extractor that protrudes because there is a cartridge in the chamber. Several pistols, e.g. Heckler & Koch USP, P8, P2000, P30, a visible part of the extractor is colored (red), in order to create a noticeable visual contrast when the pistol has a chambered round.

With the aforementioned examples of loading state indicators, the shooter can therefore determine the loading state of the pistol when the breech is closed, without having to open the slide.

A direct method for checking the loading state is the so-called chamber check, which is therefore less affected by potentially malfunctioning loading state indicators. For this, the shooter opens the breech directly (in the case of a pistol) or indirectly (in the case of a rifle, via the loading lever), in order to see a cartridge potentially stuck to the extractor, and still partially within the chamber. This direct method provides the shooter with direct visual feedback regarding the loading state of the firearm.

With a chamber check, the shooter must nevertheless take the following into account: If the shooter does not open the breech far enough, the cartridge will not be visible. If the shooter opens the breech too far, the cartridge is ejected, or jams, such that the breech may remain partially open in the worst case, or a so-called double-loading with the next cartridge in the magazine may occur.

These loading state checks are normally carried out immediately before using the weapon, and thus frequently close to adversaries (e.g. before entering a building). If any of the aforementioned problems occur, they may result in noises, or weapon failure, thus resulting in immediate danger to the shooter.

For this reason, a shooter should only retract the breechblock, or a cartridge in the chamber, to a certain distance from the chamber. This allows for visual verification of the loading state via the ejection slot, without ejecting the partially extracted cartridge. Furthermore, a cartridge in the magazine cannot be run over by the breech and be fed, thus preventing double-loading.

In this regard, firing/safety tabs on the Kalashnikov and GALIL assault rifles partially cover the ejection slot and a loading lever slot when the safety is on. In this setting of the safety tab, the loading lever can only be moved back until it bears on the safety tab to check the loading state. It is then possible to visually check the chamber. With this approach, a shooter must also actuate the firing/safety tab, as an additional mechanism, to check the chamber.

It is not possible, or purposeful, with every type of firearm to use a firing/safety tab as a limiter for retracting the breechblock, because the spacing window in question depends on the caliber and the breechblock construction, and is therefore different for each weapon. The use of mechanisms tailored to each weapon would be conceivable. This would increase production costs and limit possibilities regarding retrofitting, as well as increasing number of components that are susceptible to malfunction and wear.

Furthermore, the Heckler & Koch USP pistol is also known, in which the slide has a slot in its lower surface. To disassemble the firearm, the shooter slides the slide back until the so-called slide release axle can be seen in the slot. The slide can then be released from the rest of the pistol. The newer models of this pistol also eject a cartridge from the chamber at this position. This prevents disassembly of a weapon that is ready to fire, but does not enable a chamber check. With older models, the cartridges are not ejected at this position, fundamentally enabling a chamber check when the slide is in this disassembly position, even though this is not the intention.

FIG. 1 shows the right-hand side of an assault rifle 10 with vertical reference elements 12*a-f*. The other elements of the assault rifle 10 are known to the person skilled in the art, and need no explanation.

Figure 2:
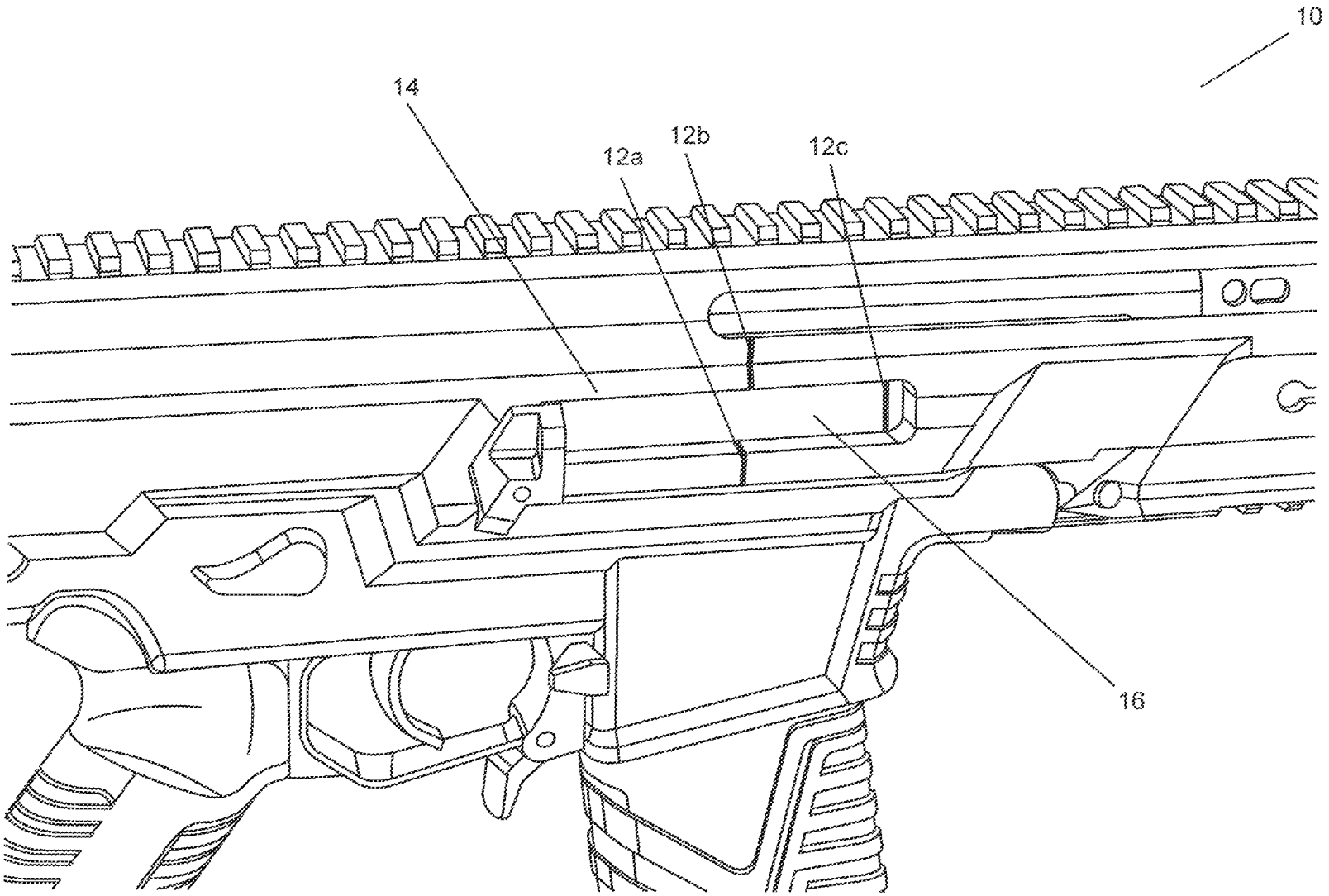
FIG. 2 shows an enlargement of a portion of the assault rifle from FIG. 1.

FIG. 2 shows an enlargement of a portion of the assault rifle 10 with vertical reference elements 12*a-c* on the upper and lower sides of an ejection slot 14 as well as on the front edge of the breechblock carrier 16 in the front, inner part of the ejection slot 14.

Figure 3:
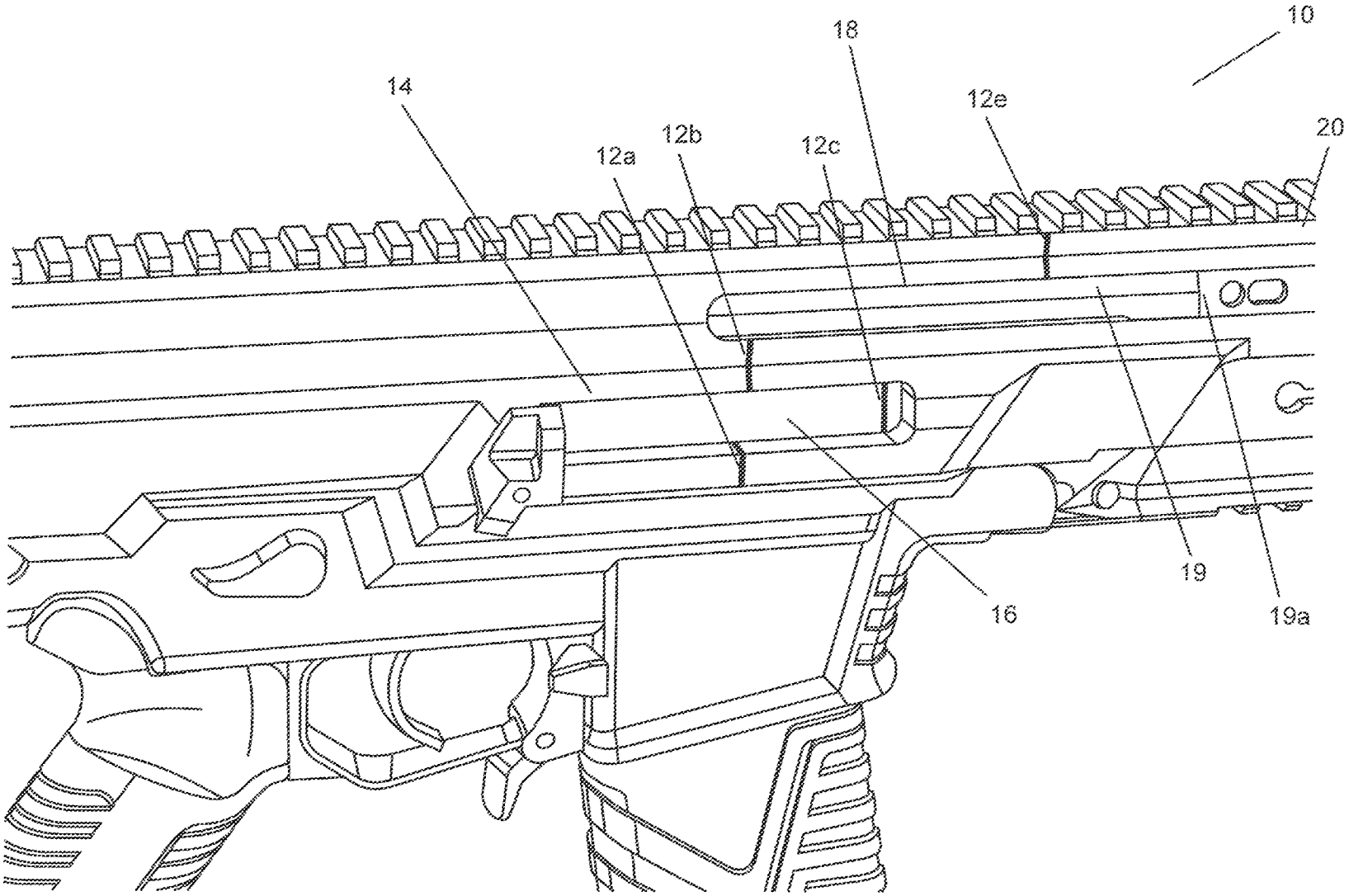
FIG. 3 shows the enlargement from FIG. 2 with an additional reference element.

FIG. 3 shows the assault rifle 10 in FIG. 2, which has an additional reference element 12*e*. There is a reference element 12*e* on the upper surface of the receiver/weapon housing, above a receiver slot 18 for a loading lever retainer 19 for the loading lever that can be attached on both sides (not shown), which extends along a lateral edge of the Picatinny rail 20 on the upper surface of the receiver. The breechblock (not shown) and the loading lever retainer 19 are in their forward, closed positions. To check the loading state, a shooter can pull the visible front edge 19*a* of the loading lever retainer 19 back to the reference element 12*e* (see FIG. 5).

Figure 4:
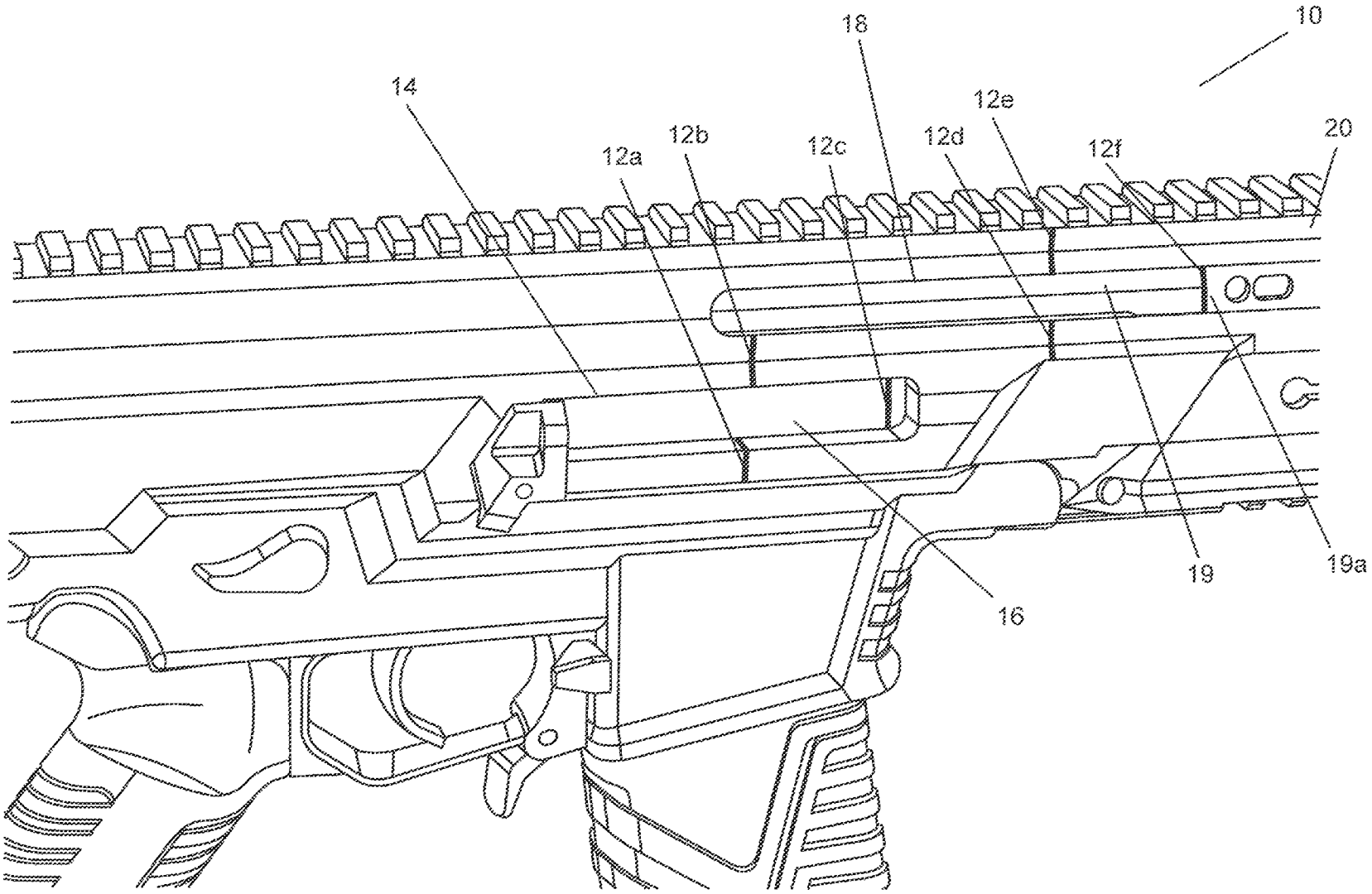
FIG. 4 shows the enlargement from FIG. 3, with a further reference element.

FIG. 4 shows the assault rifle 10 in FIG. 3. In addition to the reference elements 12*a-c* and 12*e*, the lower surface of the receiver slot/s 18 and the rear edge 19*a* of the loading lever retainer 19 have vertical reference elements 12*d, f*.

Figure 5:
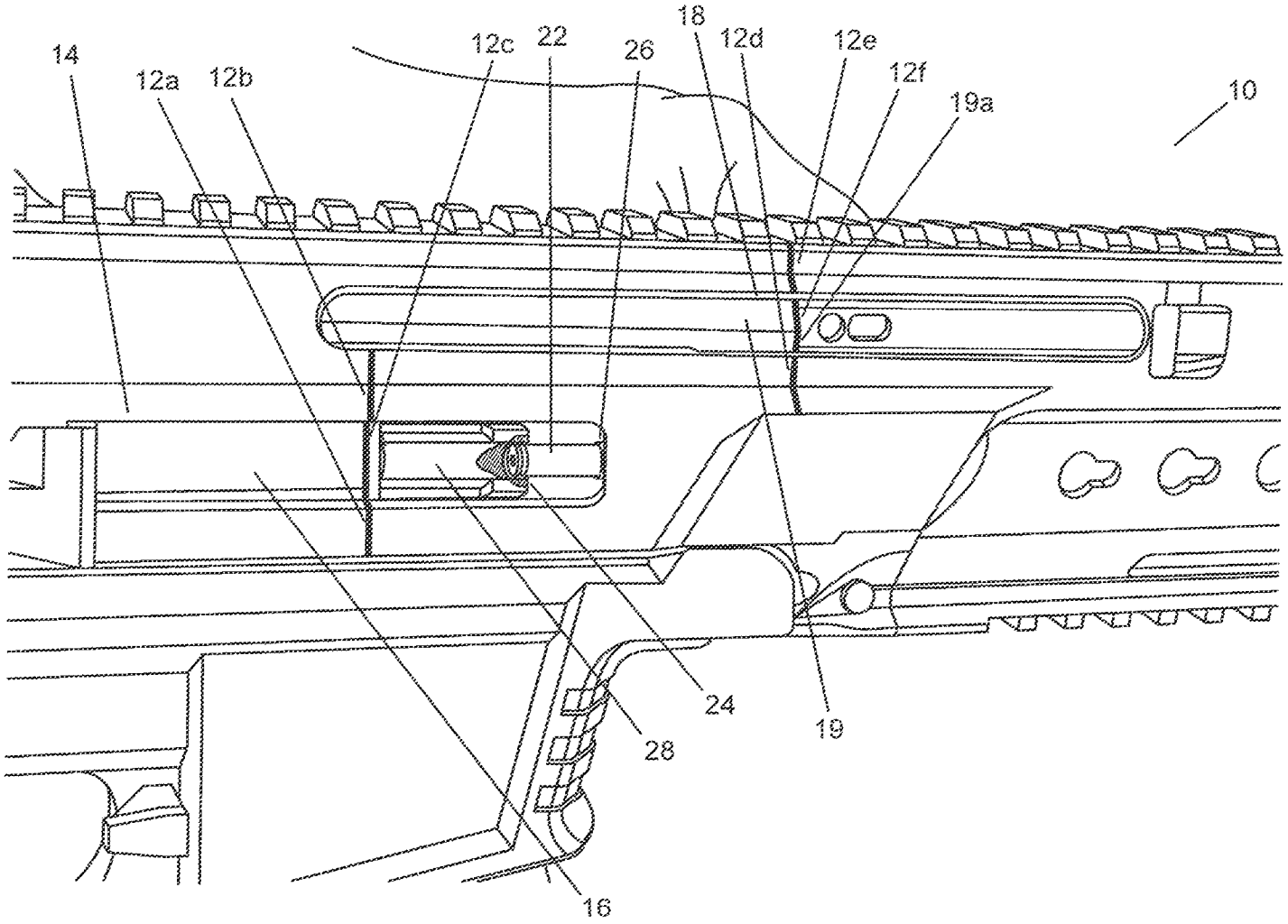
FIG. 5 shows the assault rifle from FIGS. 1 and 4, with the loading lever actuated for checking the loading state, and a visible cartridge.

FIG. 5 shows the assault rifle 10 in FIGS. 1 and 4, with the loading lever actuated, in order to check the loading state. The loading lever and the breechblock in contact therewith are pulled back until the reference elements 12*c*, 12*f* on the breechblock carrier 16 and on the loading lever retainer 19 are flush with the vertical reference elements 12*a, b*, or 12*d*, 3 on the ejection slot 14, or the receiver slot 18, respectively. A breechblock head 24 rotatably mounted in the breechblock carrier 16 is shown in a cutaway drawing of its front part. As a result, the rear part of the cartridge 22, which has been partially extracted from the chamber 26, is visible.

In this partially open position of the breechblock, the shooter can determine whether there is a cartridge 22 at the breechblock head 24 and in the chamber 26, from the side or from the back, visually or by feel, via the ejection slot 14.

In general, and independently of the examples described herein and shown in the drawings, if a shooter makes sure that the markings are flush, there is no danger that he will unintentionally eject the partially extracted cartridge when checking the chamber. Furthermore, when the magazine is inserted, the cartridges therein will not be run over and loaded inadvertently to the chamber, potentially resulting in a double-loading.

As a result, if a shooter checks the positions of the markings when checking the loading state of a weapon after the magazine has been inserted, not only an unintentional ejection of the cartridges in the chamber is prevented, but the cartridges are also prevented from exiting the magazine through the breech, resulting in a malfunctioning double-loading, or jamming.

Figure 6:
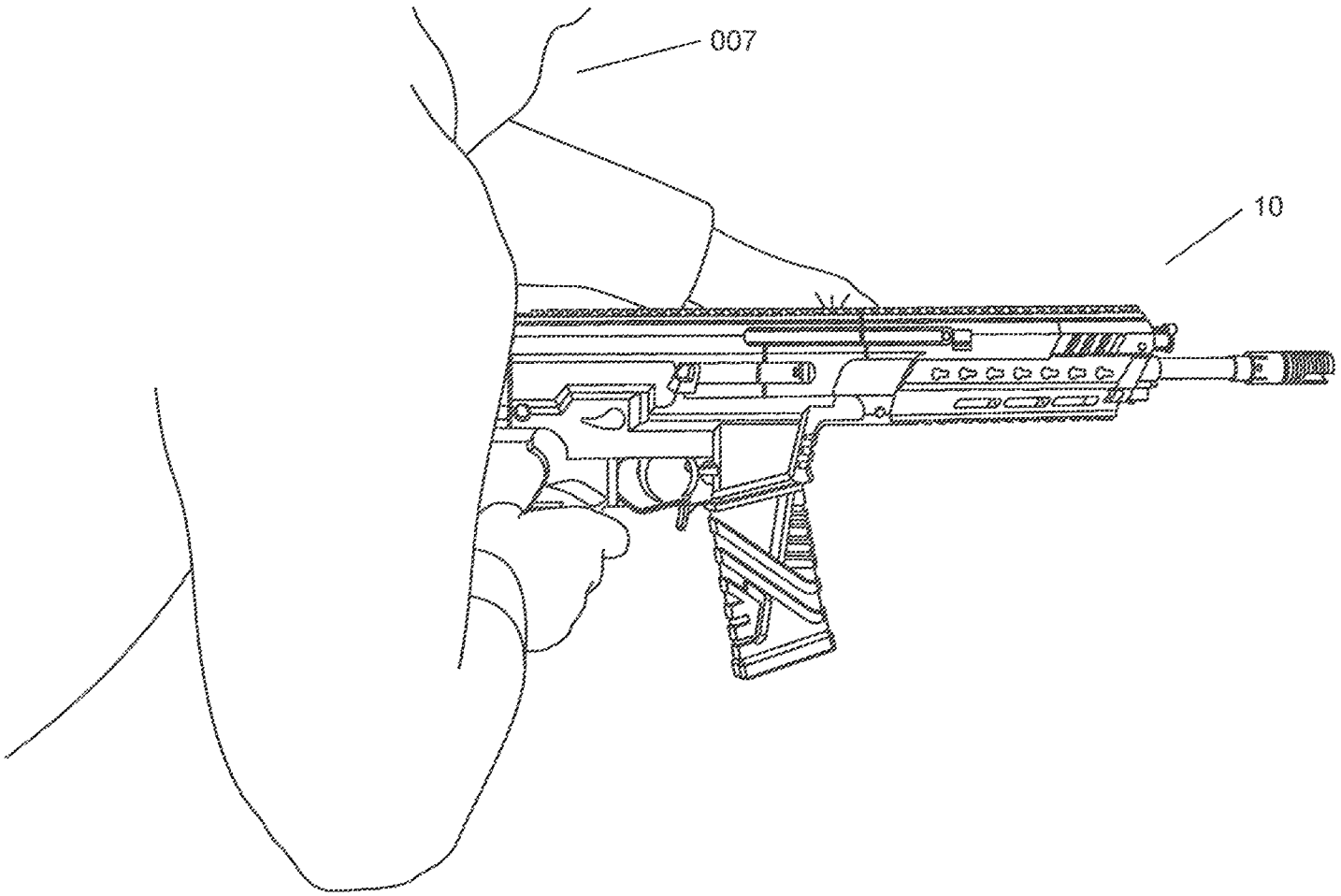
FIG. 6 shows the assault rifle from FIGS. 1 and 5 with a shooter checking the loading state.

FIG. 6 shows the right-hand side of the assault rifle 10 when the loading lever has been actuated by a shooter 007 to check the loading state.

Figure 7:
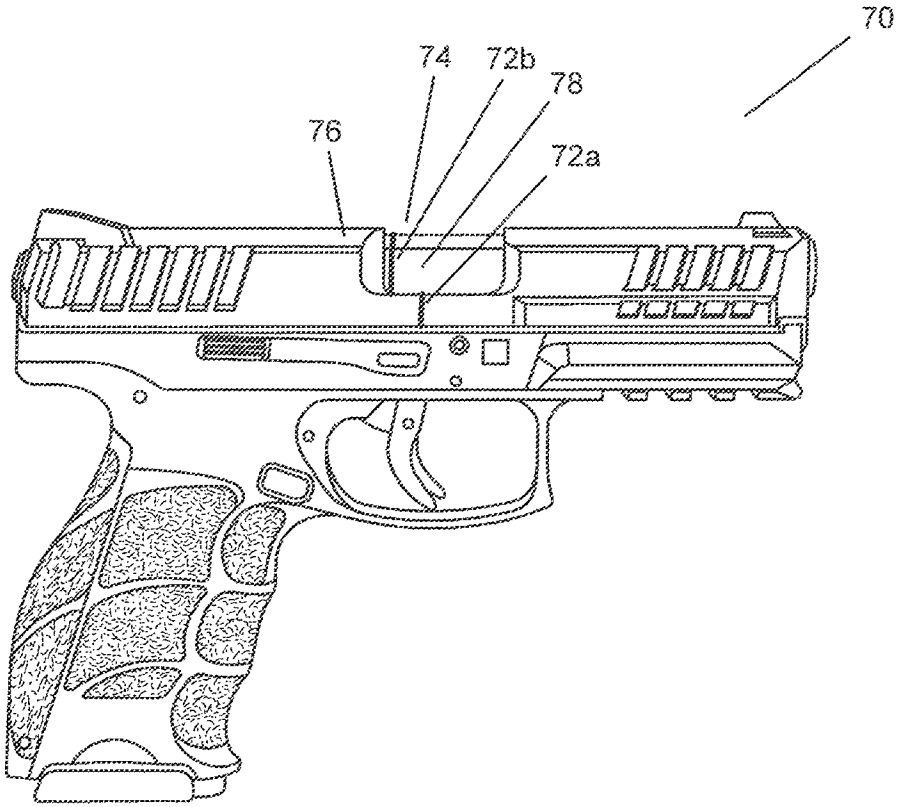
FIG. 7 shows the right-hand side of a pistol, with vertical reference elements.

FIG. 7 shows the right-hand side of a pistol 70 with vertical reference elements 72*a, b* on the open side of an ejection slot 74 on the slide 76 and on the upper surface of the cartridge bearing side end of a tube 78.

Figure 8:
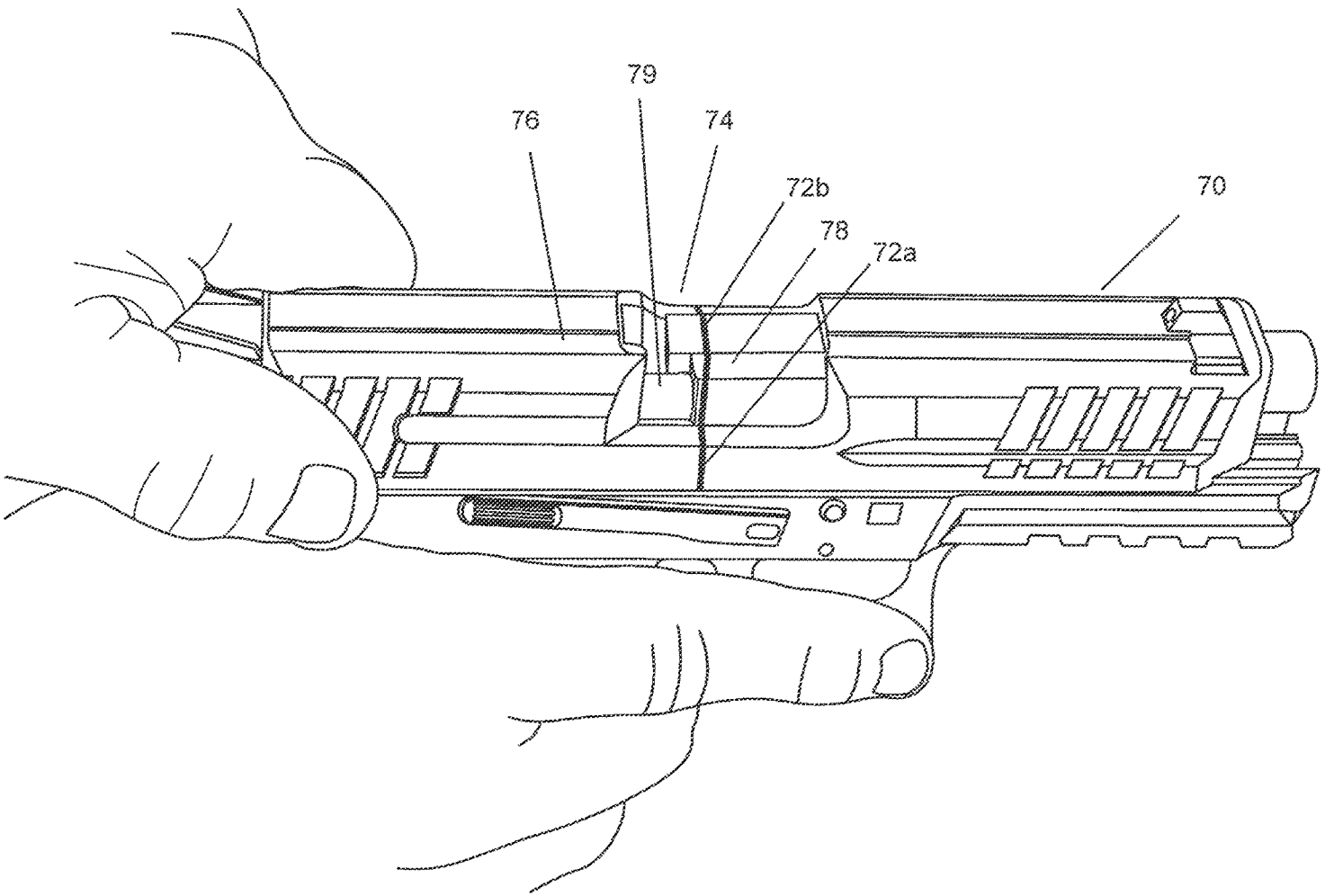
FIG. 8 shows the pistol in FIG. 7 while checking the chamber, with the slide pulled back, and a visible cartridge.

FIG. 8 shows the handling of the pistol 70 when determining the loading state. The right, upper surface of the pistol 70 is visible, with the reference elements 72*a, b* on the right-hand side of the slide 76 on the lower edge of the ejection slot 74, and the right-hand side and the upper surface of the cartridge bearing side end of the tube 78.

To check the loading state, a shooter pulls the slide 76 back until the reference elements on the slide 72*a* and the chamber end of the tube 72*b* are flush. As a result, he can pull a cartridge 79 in the chamber far enough out to see or feel it.

When the shooter releases the slide 76, it pushes the partially extracted cartridge 79 back, and readies the pistol 70 for firing, without unintentionally ejecting the checked cartridge, and without loading a cartridge in the magazine through the breech.

Figure 9:
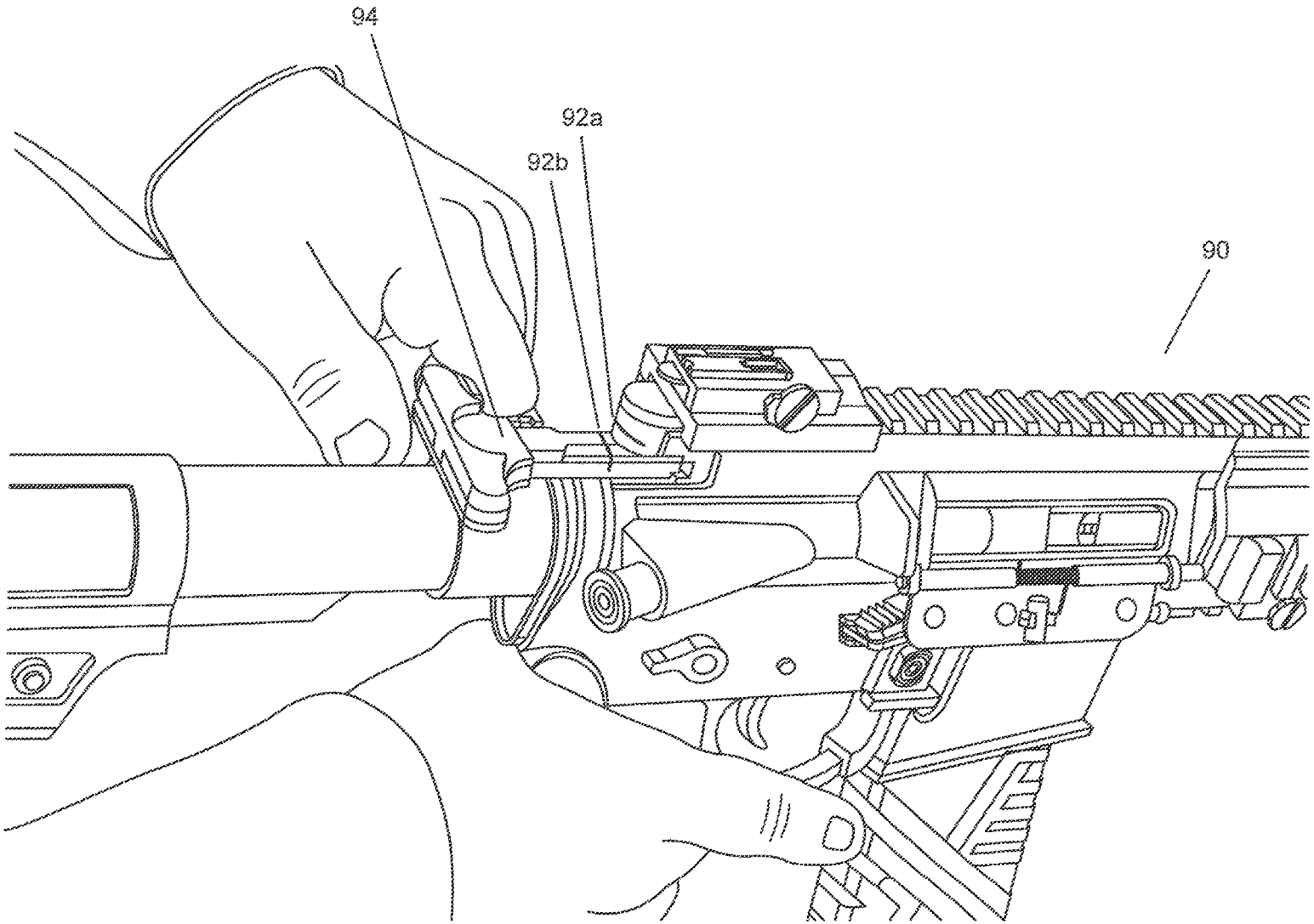
FIG. 9 shows an assault rifle with horizontal reference elements.

FIG. 9 shows an assault rifle 90 with horizontal reference elements 92*a, b* on a loading lever 94 that can be pulled out at the back and on the back of the rifle 90.

Figure 10:
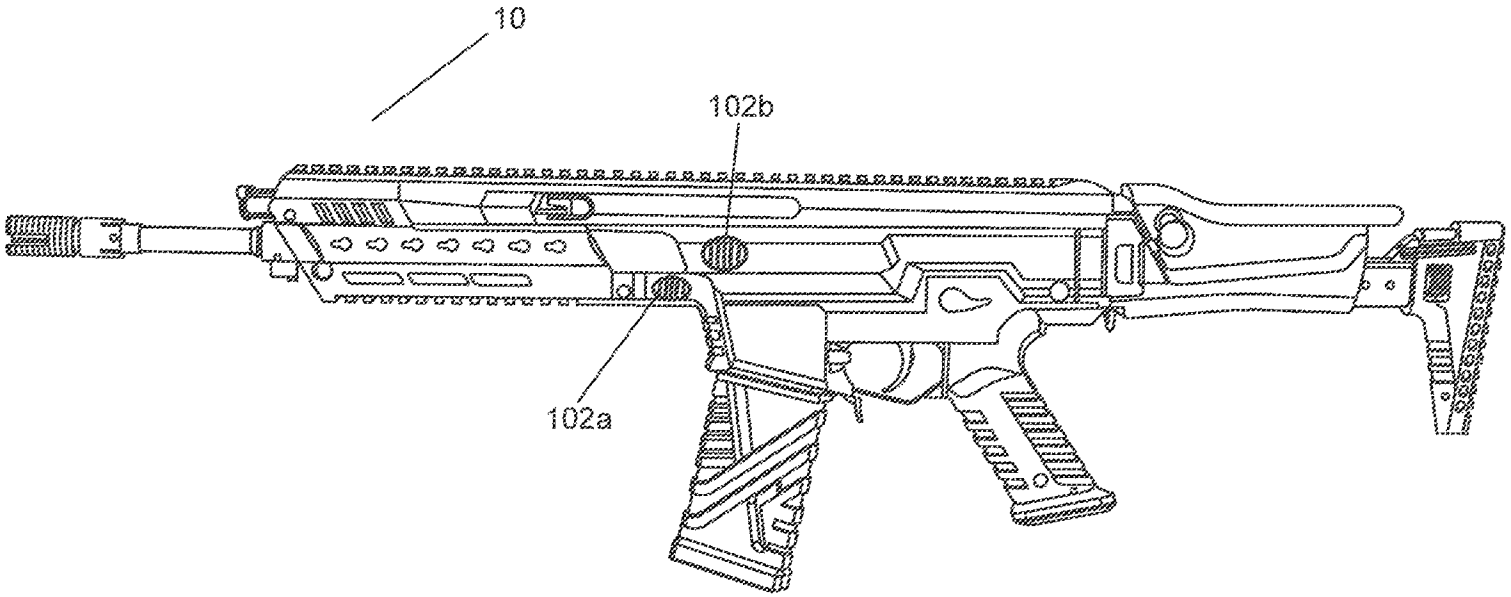
FIG. 10 shows the left-hand side of an assault rifle with two finger or thumb surfaces as reference elements.

FIG. 10 shows the left-hand side of an assault rifle 10 with two reference elements 102*a, b* for finger or thumb placement on the receiver.

In general, and independently of the examples shown and described herein, these finger or thumb markings are not only visible markings, but also form indentations, recesses, or bulges that can be felt. A shooter can use a finger or thumb placed in the recess as either a stop for his loading lever hand, or as a tactile or visual measure for the return movement of the loading lever and the breechblock to determine the loading state. By way of example, the predetermined position can be reached when predetermined parts of the shooter's hand are flush with predetermined parts of the breech mechanism.

The visible and/or tactile reference elements can be applied to either side of the receiver.

Figure 11:
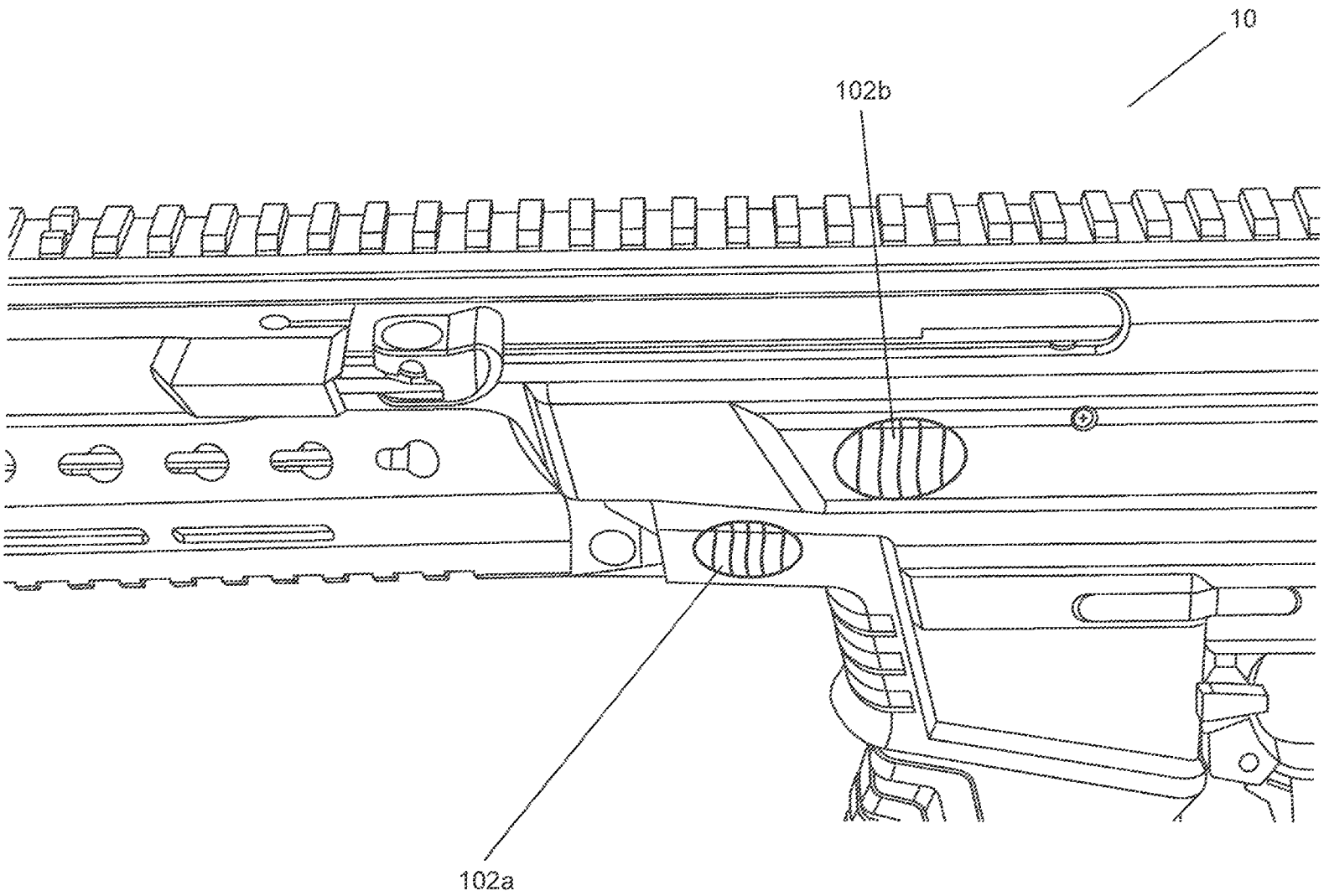
FIG. 11 shows an enlargement of a portion of the assault rifle in FIG. 10.

FIG. 11 shows an enlargement of a portion of the assault rifle 10 shown in FIG. 10, with reference elements 102*a, b*.

Figure 12A:
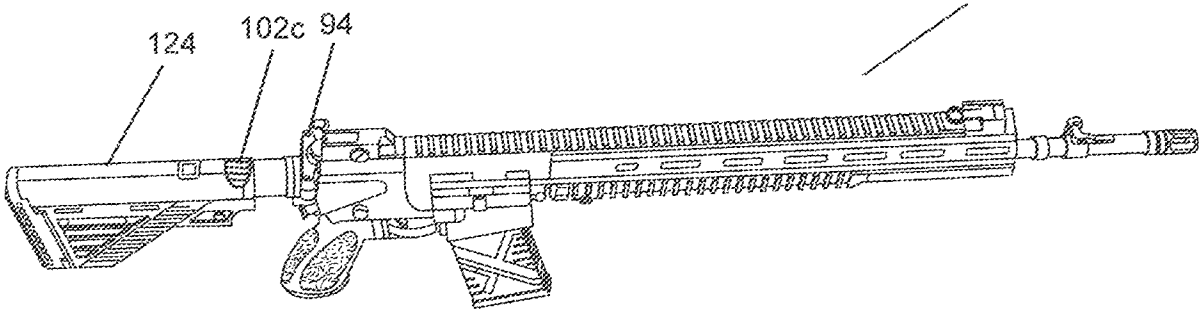
FIG. 12*a* shows another example of a weapon with a retractable shoulder rest, with reference elements in the form of finger or thumb markings.

FIG. 12*a* shows another example of a firearm 90 from a semi-tilted perspective. Another reference element 102*c* in the form of a finger or thumb marking can be seen on a retractable shoulder rest 124. The loading lever 94 is also visible.

Figure 12B:
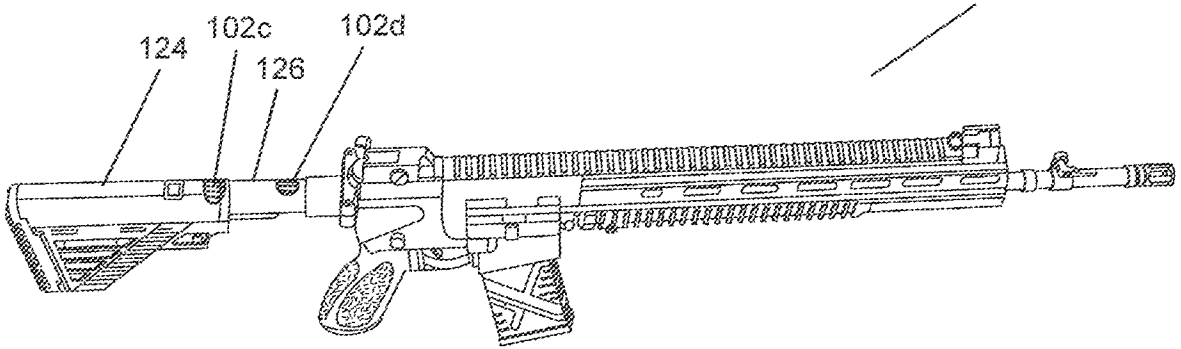
FIG. 12*b* shows the weapon in FIG. 12*a* with the shoulder rest extended, with an additional reference element on the guide tube.

FIG. 12*b* shows the firearm in FIG. 12*a* with the shoulder rest 124 fully extracted. In addition to the reference element 102*c* on the shoulder rest 124, there is also a reference element 102*d* on the guide tube 126 for the retractable shoulder rest. In the manner shown in FIGS. 12*a* and 12*b*, reference markings are available, both when the shoulder rest 124 is retracted and when it is extracted.

Figure 13:
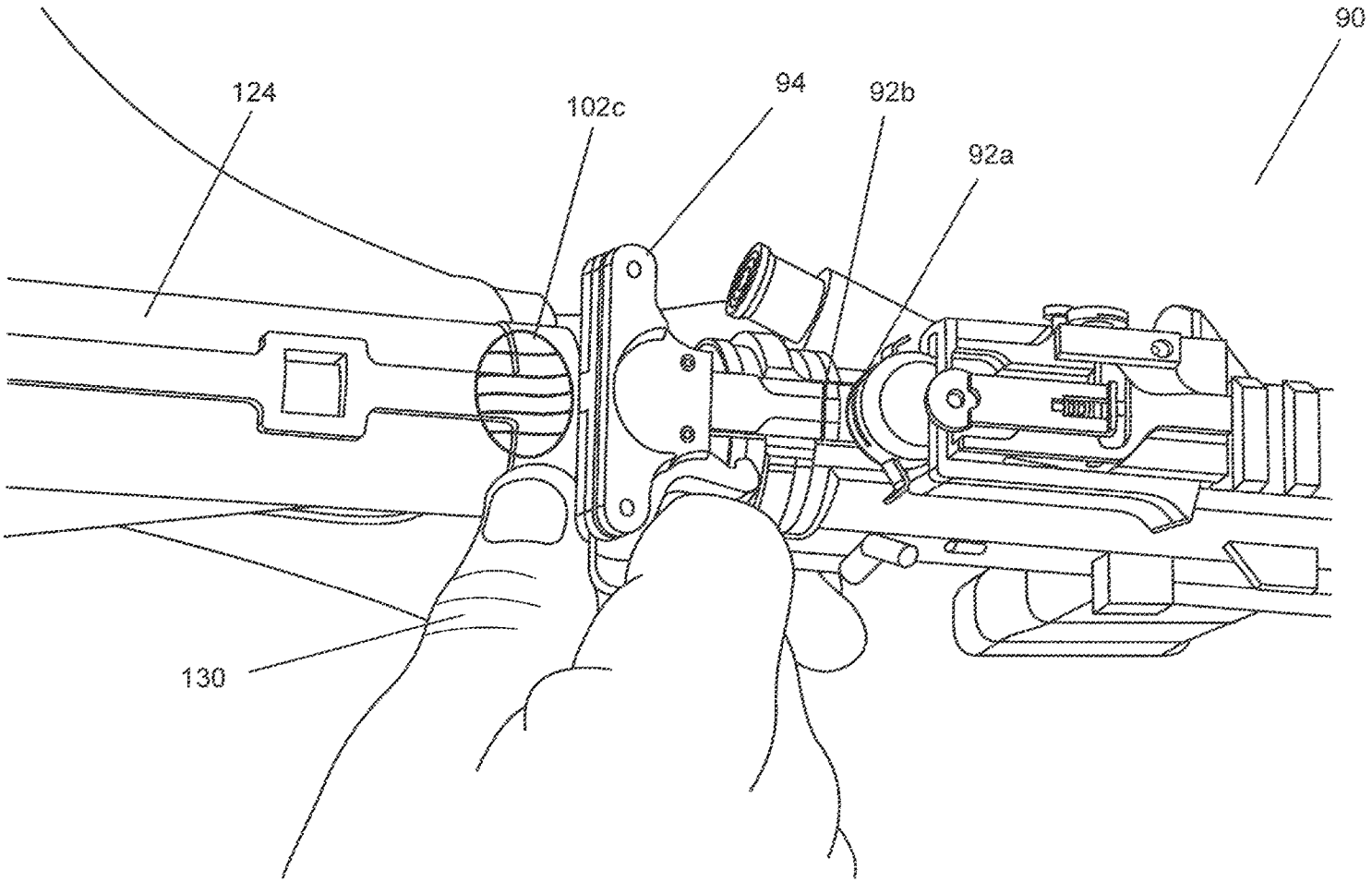
FIG. 13 shows a perspective illustration of the weapon in FIG. 12*a*, with the shoulder rest retracted, and the loading lever slid partially back to check the loading state.

FIG. 13 shows the firearm 90 with the shoulder rest 124 is retracted, and the loading lever is pulled partially back to check the loading state.

The reference element 102*c* for the finger or thumb recess can be seen on the upper surface of the retracted shoulder rest 124. When the thumb 130 is placed therein, it limits the extent to which the loading lever 94 can be pulled back for checking the loading state. In general and independently of the example, other fingers or parts of the hand, as well as other parts of the breech mechanism, can also be used.

In one aspect, an object of the examples disclosed herein is to find a way to simplify checking the chamber.

The disclosed examples achieve this object with the subject matter of independent claim 1.

The loading systems under discussion comprise, depending on the weapon, or type of weapon, loading devices, breechblock carriers and/or slides as the loading system elements. These elements can be connected to one another, e.g. a breechblock carrier or slide to a loading device, such that they can be moved back and forth conjointly.

Loading devices are used to load a firearm, in particular an automatic firearm, using a loading lever in order to ready the firearm for firing. As noted above, known loading devices are often attached to a breechblock. By engaging with the loading lever, the breechblock can be moved back, i.e. toward the stock, such that the breechblock is retracted, over the magazine, counter to the force of a closing spring. When the breechblock is subsequently moved forward, the breechblock head takes the uppermost cartridge from a magazine, and moves it forward into the chamber.

There is loading lever permanently coupled to the breechblock in the known G36 from the applicant, or the known SA 80. Such a loading lever is also known as a moving loading lever because it also moves back and forth, along with the breechblock carrier, because it is connected thereto.

There are also loading levers that do not move along with the breechblock carrier known from the AR15 variants, e.g. HK 416/417 from the same applicant. There are also loading levers that can be mounted on or removed from the loading device without tools.

In particular, there are a number of different loading systems, and in particular loading devices. By way of example, loading devices can also have a loading lever on either the left or right side of the weapon.

In that now, according to the exampled disclosed herein, at least one reference element is located at a distance to one of the positions for disassembling the firearm, a shooter can be certain that the weapon is not in a state of disassembly when checking the chamber, such that the weapon is unintentionally disassembled.

The possibility of checking the chamber independently of the safety setting of the weapon is advantageous for the shooter. As a rule, safety checks such as checking the chamber should be carried out when the safety is on. This reduces the risk of unintentional firing. In other situations, e.g. just before contact with an adversary, and thus exposed to life-threatening danger, it may be necessary to keep the weapon ready, with the safety off. In these situations, checking the chamber involves additional steps if the safety must be on, which could result in malfunctioning, noises, and loss of valuable time. This can be avoided according to the invention.

Another advantage is that the loading system elements can move freely, independently of the setting of the safety. This means that the weapon can be loaded continuously after the chamber has been checked. Two exemplary scenarios are used to illustrate these immediate advantages.

In the first scenario, the shooter sees that there is a cartridge in the chamber when checking the chamber, and wants to eject the cartridge from the chamber as quickly as possible, in order to secure the weapon. If the magazine has already been removed, the shooter only has to move the breechblock back a little further in order to remove the cartridge still in the chamber, and thus render the weapon ready to fire, without taking any further steps.

In the second scenario, a shooter wants to ensure, prior to immediate contact with an adversary, that the weapon is ready to fire. If he sees that there are no cartridges in the chamber, the breechblock only needs to be moved back in order to load the chamber by extracting a cartridge from the magazine. As a result, the shooter can quickly render the weapon ready to fire, without taking any further steps.

Because the chamber is opened far enough that it is possible to touch a cartridge potentially located in the chamber, without ejecting the cartridge, the shooter can check the chamber purely by feel, without having to look, e.g. if it is too dark to see.

Further possible examples can be derived from the dependent claims, which shall be explained below.

In one example (claim 2), there are at least one or more stationary reference elements attached to the weapon, making the functions of the reference elements easier to identify by the shooter, and reducing the potential of a malfunction, as described above.

In one example (claim 3), there are at least one of one or more reference elements attached to the weapon that can move in relation to the stationary reference elements.

In one example (claim 4), at least one reference element is located outside the area the elements of the loading system pass over when returning along their respective trajectories. The reference elements are arranged such that, e.g., although they are in the immediate vicinity of the trajectories of the loading system elements, they cannot block the movements thereof, e.g. in that they protrude into the respective areas, or can be moved therein. When the reference elements are arranged in this manner, it is ensured that the area needed for an unimpaired back and forth movement of the loading system elements remains free, such that it is possible to load the weapon at all times, without obstruction.

In one example (claim 5), at least one reference element is connected to one or more of the elements in the loading system. As a result, this reference element can also move conjointly therewith.

Depending on the example, and the type of firearm, the moving reference elements can be attached at different locations. With pistols, they can be attached directly to the slide, serving as the loading device, and/or the tubes encompassed by it, attached in a stationary manner to the handle, or that can move to a limited extent in relation to the handle. With rifles, this can be, e.g., both on the separate loading system elements, as well as on the breechblock parts that are moved by the parts of the loading device and can be seen during the loading procedure.

By way of example, the reference element can be a colored or milled marking applied to the moving breechblock, a moving element on the loading device, some other moving part of the loading system, or the stationary receiver.

In one example (claim 6), which comprises at least two reference elements, at least one first stationary reference element is located outside the area that one or more loading system elements passes over when returned along its trajectory. This example also comprises at least one second moving reference element, which is connected to at least one of the loading system elements, e.g. the loading device, the slide, or the breechblock carrier. The predetermined position of the loading system element is then reached when the first and second reference elements are in a predetermined position in relation to one another. By way of example, this is the case when a first and second reference element are brought into a predetermined position in which they are flush to one another, or a predetermined position that can otherwise be reproduced, e.g. visually or by feel.

In one example, a first reference element can be applied to the outer edge of the breech, and a second reference element can be applied to the breechblock carrier itself. If the two reference elements are flush with one another, the shooter knows that the breech is open far enough to check the chamber. In this example, the advantages of the aforementioned exemplary examples are combined, and desired position for checking a chamber can be reproduced easily.

In another example (claim 7), at least one reference element is located on the side of a weapon with an ejection slot where the ejection slot is also located. This ensures that the shooter can determine the loading state of the weapon via the ejection slot immediately after the loading system element(s) have been brought into the predetermined position using the at least one reference element, without having to first rotate the weapon. If the reference elements are applied to the side of the weapon opposite the ejection slot, it would not be possible, or only possible to a limited extent, to check the chamber from this side, depending on the design of the weapon.

In another example (claim 8), the at least one reference element marks at least one position on the firearm. It therefore serves as a marking. A shooter can position a hand or at least a first part thereof at this position, e.g. when holding the firearm, in such a way that the hand or at least a part thereof makes the predetermined position of at least one of the through-loading system elements haptically findable or identifiable.

In another example (claim 9), the hand, or at least a part thereof, prevents the return of at least one of the loading system elements past the predetermined position. The hand then functions as a stop.

By way of example, in examples such as the last two, a ribbed recess can be formed below the loading lever on a rifle. If the shooter then positions, e.g. the tip of the thumb on his loading hand in the recess before or while pulling back the breechblock via the loading lever, the tip of the thumb, or another part of the hand, serves to mark the position to which the breechblock can be pulled back for a chamber check. By way of example, the tip of the thumb, or the other part of the hand, can serve to mark the position visually, or as a stop. In the latter case, the breechblock, or the loading lever that moves it, strikes the thumb at a position suitable for a chamber check, such that the breechblock cannot be retracted past this point, and it is possible to check the chamber without risk of ejecting a cartridge. However, when the shooter removes his hand from the recess, the weapon can be loaded. Other fingers or parts of the hand can also be used for this.

In general, these thumb recesses can be placed selectively on the upper or lower part of the receiver of a rifle, on a pistol grip, or any other suitable point on the surface of the weapon that enables an ergonomic forced limitation of the movement of the breechblock, and/or characterizes a position to which a shooter may allow elements in a loading system to be retracted in order to check the chamber.

In other examples (claim 10), at least one reference element can be in the form of a line, arrow, dot, and/or other symbol. If the weapon has more than one reference elements, the reference elements can all be in the form of the same symbol, or the individual reference elements can each differ from one another. As such, symbols that are adapted to the shooters or the respective areas of operations can be used, e.g. to ensure that they can be read optimally, or to individualize the weapon.

In another example (claim 11), at least one reference element stands out tactilely and/or visually. By way of example, it can protrude from the surface of the weapon, be roughened, and/or coated. A shooter can thus locate the reference element by feel, without visual contact, e.g. in the dark. Alternatively or additionally, a reference element can also be visually identifiable. By way of example, it can be colored, or the surface can be altered. In particular, colors can be used for this that can be seen easily in conditions that afford poor visibility, and/or poorly lit conditions. Aside from signal colors such as red and orange, colors can also be used that result in signaling effects when seen using special light or glasses with special filters. By way of example, colors can be used that exhibit a strong contrast when seen with night vision goggles or polarizing filters, which are UV-active and/or fluorescent. These features enable quick and reliable location of the reference elements.

In another example (claim 12), at least one reference element is in the form of a recess, bulge, or some other formation on the surface of the weapon, or a combination thereof. This has the effect discussed above, that a shooter can quickly locate the reference element by feel and/or visually, even when visually impaired, or unable to see it.

By way of example, in another example (claim 13), at least one reference element is a ribbed recess.

In general, and independently of the concrete example, a reference element can be made of metal, ceramic, hard plastic, soft plastic, leather, rubber, India rubber, or some other suitable material. A suitable material can be selected depending on the design of the reference element(s), e.g. in adapting it to operational requirements.

In other examples (claim 14), at least one reference element is formed by applying color, soldering, gluing, welding, milling, engraving, stamping, pressing, etching, or casting. A suitable production method can be selected on the basis of the field of use, or user requirements. Furthermore, the production method can also be selected such that the rest of the weapon can be integrated in the production process. Ultimately, production through applying color, gluing, soldering, welding and etching also allows for subsequent application of reference elements, and therefore the retrofitting of a weapon that originally had no reference elements.

There are also horizontal reference elements 92*a, b* in this example on the rear surface of the receiver and on the upper surface of the loading lever 94, which indicate the position to which a shooter can retract the loading lever to check the loading state.

What is claimed is:

1. A firearm loading system comprising:

a retractable loading system element that follows a trajectory when retracted; and a reference element that indicates a predetermined position of the retractable loading system element along the trajectory at which a chamber of the firearm loading system is open, such that a cartridge potentially located in the chamber can be detected, but is not ejected, wherein the predetermined position of the retractable loading system element is distanced from a position for disassembling the firearm loading system, and wherein the reference element is formed such that the retractable loading system element can travel freely along the trajectory when a safety for the firearm loading system is either on or off.

2. The firearm loading system according to claim 1, wherein the reference element comprises a stationary reference element.

3. The firearm loading system according to claim 1, wherein the reference element comprises a moving reference element.

4. The firearm loading system according to claim 1, wherein the reference element is located outside an area that the retractable loading system element passes over when retracted along the trajectory.

5. The firearm loading system according to claim 1, wherein the reference element is connected to the retractable loading system element, and moves therewith.

6. The firearm loading system according to claim 5, wherein the reference element is a first reference element, the firearm loading system further comprising a second reference element associated with the first reference element, wherein the predetermined position of the retractable loading system element has been reached when the first and second reference elements are in relative positions in relation to one another.

7. The firearm loading system according to claim 6, wherein the predetermined position of the retractable loading system element has been reached when the first and second reference elements are flush with one another.

8. The firearm loading system according to claim 1, further comprising an ejection slot, wherein the reference element is on a side of the ejection slot.

9. The firearm loading system according to claim 1, wherein the reference element forms a marking at a location on the firearm loading system at which a hand can be positioned such that the predetermined position of at least one of the retractable loading system elements can be felt by the hand.

10. The firearm loading system according to claim 9, wherein the hand prevents retracting the retractable loading system element past the predetermined position.

11. The firearm loading system according to claim 1, wherein the reference element can be readily seen or felt.

12. The firearm loading system according to claim 9, wherein the reference element can be readily seen or felt.

13. The firearm loading system according to claim 1, wherein the reference element is formed on the firearm loading system as a recess, bulge, or otherwise protruding on its surface, or a combination thereof.

14. The firearm loading system according to claim 12, wherein the reference element is formed by a ribbed recess.

15. The firearm loading system according to claim 1, wherein the reference element is formed by an application of color, soldering, gluing, welding, milling, engraving, stamping, pressing, etching, and/or casting.

* * * * *